US006712206B2

(12) United States Patent
Chen

(10) Patent No.: US 6,712,206 B2
(45) Date of Patent: Mar. 30, 2004

(54) HEAD FRAME FOR GOLF CLUB-BAGGING DEVICE

(75) Inventor: Changfu Chen, Taipei (TW)

(73) Assignee: Chenterlon Inc., Taichung (TW)

( * ) Notice: Subject to any disclaimer, the term of this patent is extended or adjusted under 35 U.S.C. 154(b) by 53 days.

(21) Appl. No.: 10/227,374

(22) Filed: Aug. 23, 2002

(65) Prior Publication Data

US 2002/0189962 A1 Dec. 19, 2002

Related U.S. Application Data

(63) Continuation-in-part of application No. 09/595,233, filed on Jun. 16, 2000, now Pat. No. 6,513,653.

(51) Int. Cl.[7] ..... A63B 55/00
(52) U.S. Cl. ..... 206/315.7; 248/96; D3/255
(58) Field of Search ..... 206/315.3, 315.6, 206/315.7; 248/96; D3/255

(56) References Cited

U.S. PATENT DOCUMENTS

| | | | | |
|---|---|---|---|---|
| 1,404,559 | A | | 1/1922 | Watrous |
| 1,555,019 | A | | 9/1925 | MacDonald |
| 1,769,011 | A | | 7/1930 | Bickford |
| 2,064,542 | A | | 12/1936 | Jones |
| 2,148,947 | A | | 2/1939 | Jackson |
| 2,482,372 | A | | 4/1949 | Rossow |
| 5,236,085 | A | | 8/1993 | Quellais |
| 5,397,084 | A | * | 3/1995 | Wang ..... 248/96 |
| 5,673,879 | A | | 10/1997 | Hsieh |
| 6,062,383 | A | | 5/2000 | Han |
| 6,227,503 | B1 | | 5/2001 | Shiao Chen |
| 6,241,201 | B1 | | 6/2001 | Wang |
| 6,241,202 | B1 | | 6/2001 | Chen |
| 6,296,117 | B1 | * | 10/2001 | Chen ..... 206/315.7 |
| 6,298,988 | B1 | * | 10/2001 | Wen-Chien ..... 206/315.7 |
| 6,299,112 | B1 | | 10/2001 | Suk |
| 6,435,345 | B1 | * | 8/2002 | Wang ..... 206/315.7 |
| 6,581,767 | B2 | * | 6/2003 | Cheng ..... 206/315.7 |
| 6,598,744 | B2 | * | 7/2003 | Chen ..... 206/315.7 |
| 6,609,615 | B2 | * | 8/2003 | Lin ..... 206/315.7 |

* cited by examiner

*Primary Examiner*—Stephen K. Cronin
(74) *Attorney, Agent, or Firm*—Alan Kamrath

(57) ABSTRACT

A golf club-bagging device includes a head frame, a bag and two supporting rods. The head frame includes a board extending from a lower edge thereof, a base formed on the board and two spaced pivotal seats formed on the base. The bag defines a hole. The bag is mounted on the head frame so that the pivotal seats and the base are inserted through the hole. Each of the supporting rods is pivotally connected with one of pivotal seats. The bag includes a thickness equal to that of the base so that the bag is flush with the base when the bag is mounted on the head frame. The base is integrated with the board via injection molding. The head frame pivotal seats are integrated with the base via injection molding.

12 Claims, 9 Drawing Sheets

HEAD FRAME FOR GOLF CLUB-BAGGING DEVICE

CROSS REFERENCE

The present patent application is a continuation-in-part ("CIP") application of U.S. patent application Ser. No. 09/595,233, filed on Jun. 16, 2000, now U.S. Pat. No. 6,513,653.

BACKGROUND OF INVENTION

1. Field of Invention

The present invention relates to a golf club-bagging device including a bag and a robust head frame on which the bag can be easily and efficiently mounted.

2. Description of Related Prior Art

U.S. patent application Ser. No. 09/595,233 teaches a golf club-bagging device including a bag and a head frame. The bag defines at least one aperture. The head frame includes a board and at least one pivotal seat formed on the board. At least one supporting rod is pivotally connected with the at least one pivotal seat. The at least one pivotal seat includes a block formed on the board, a stop formed on the block and a pivotal section formed on the stop. A gap is defined between the head frame and the stop. The bag is mounted on the head frame so that the at least one pivotal seat is inserted through the at least one aperture. The mounting of the bag on the head frame is easy and efficient. An annular portion of the bag around the at least one aperture is located in the gap between the head frame and the stop. An end of the at least one supporting rod is pivotally connected with the pivotal section. The at least one supporting rod can be pivotally moved from the bag in order to help the bag stand. However, in use, the at least one pivotal seat may be subjected to a large torque that may torn it from the board.

The present invention is therefore intended to obviate or at least alleviate the problems encountered in prior art.

SUMMARY OF INVENTION

It is the primary objective of the present invention to provide a golf club-bagging device including a bag and a robust head frame on which the bag can be easily and efficiently mounted.

According to the present invention, a golf club-bagging device includes a head frame, a bag and two supporting rods. The head frame includes a board extending from a lower edge thereof, a base formed on the board and two spaced pivotal seats formed on the base. The bag defines a hole. The bag is mounted on the head frame so that the pivotal seats and the base are inserted through the hole. Each of the supporting rods is pivotally connected with one of pivotal seats. The bag includes a thickness equal to that of the base so that the bag is flush with the base when the bag is mounted on the head frame. The base is integrated with the board via injection molding. The head frame pivotal seats are integrated with the base via injection molding.

Other objectives, advantages and features of the present invention will become apparent from the following detailed description when taken in conjunction with the drawings.

DETAILED DESCRIPTION OF EMBODIMENTS

Figure 1:
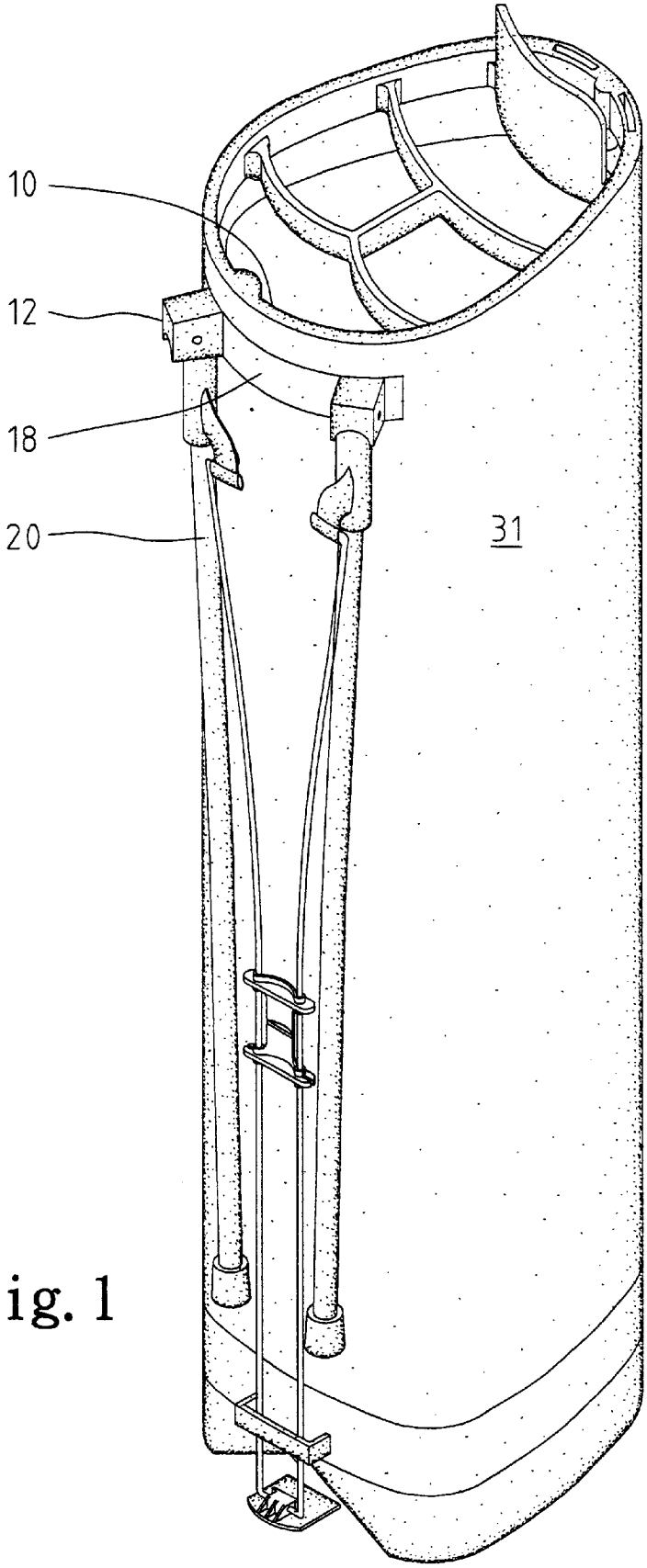
FIG. 1 is a perspective view of a golf club-bagging device according to a first embodiment of the present invention.
Figure 2:
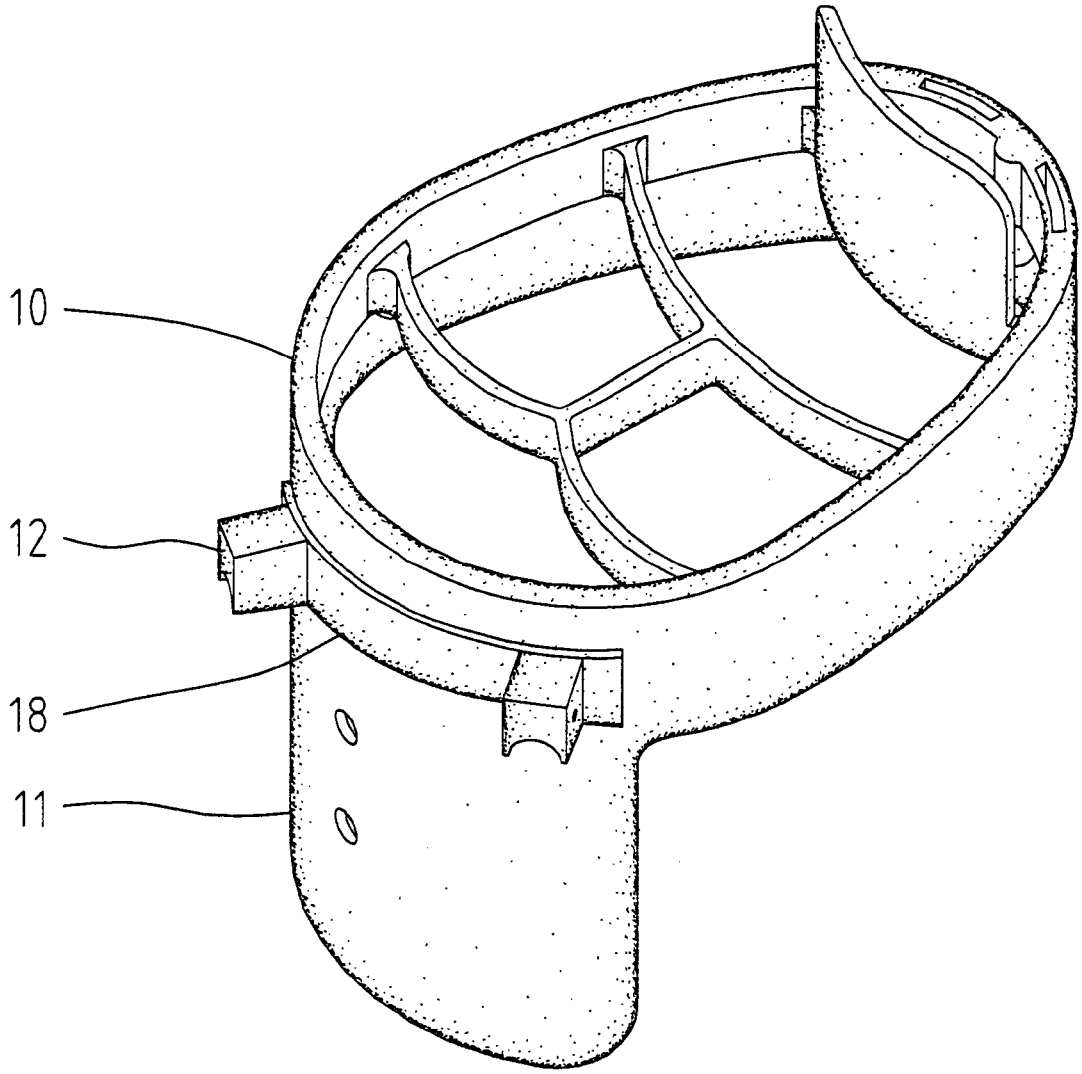
FIG. 2 is a perspective view of a head frame for use in a golf club-bagging device according to the first embodiment of the present invention.
Figure 3:
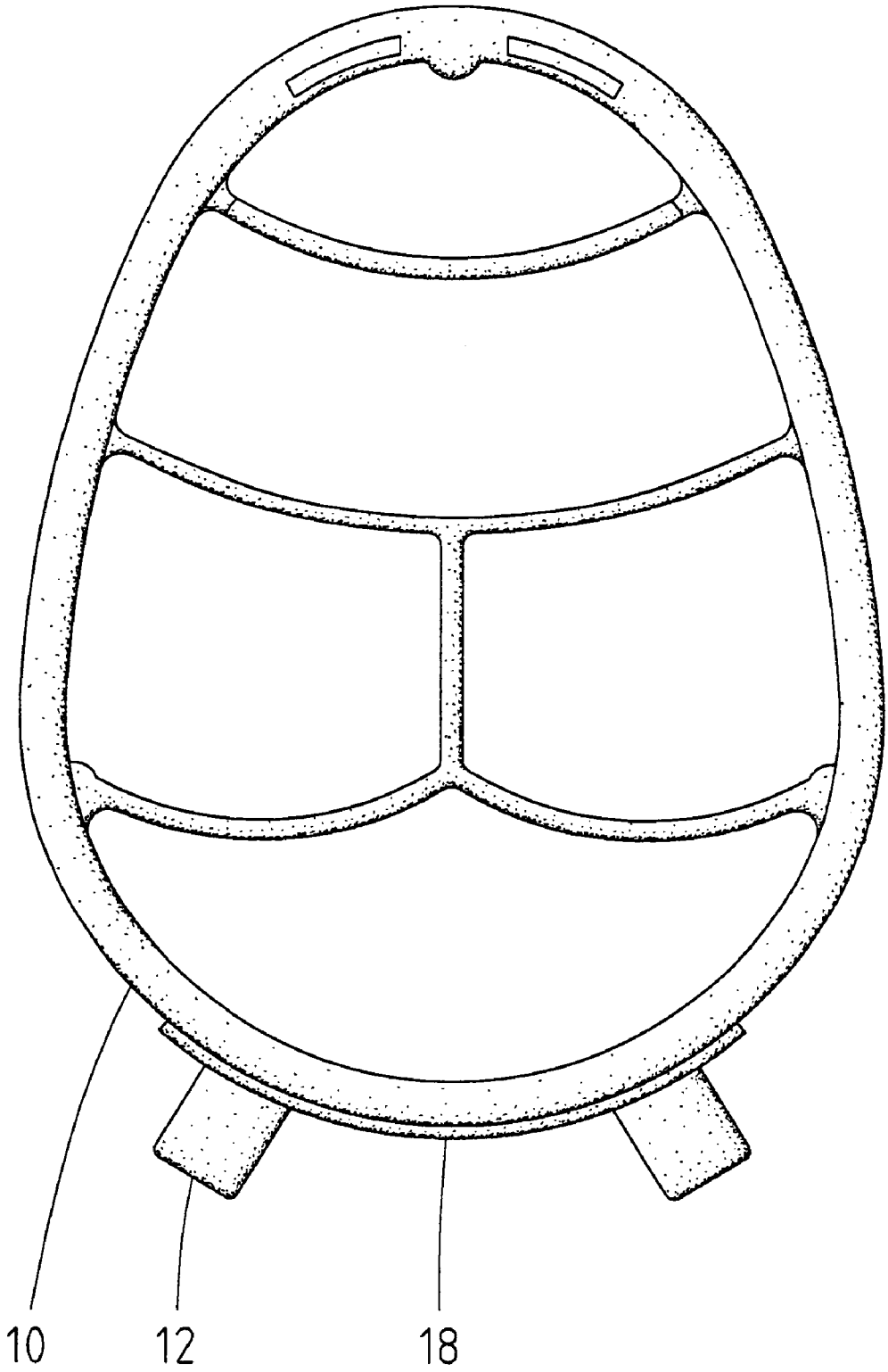
FIG. 3 is a top view of a head frame for use in a golf club-bagging device according to the first embodiment of the present invention.

Referring to FIGS. 1~3, in accordance with a first embodiment of the present invention, a golf club-bagging device includes a head frame 10, a bag 31 mounted on the head frame 10 and two supporting rods 20 pivotally connected with the head frame 10.

The head frame 10 includes a board 11 extending from a lower edge thereof. The board 11 is integrally formed with the head frame 10 via injection molding. A base 18 is integrally formed on the board 11 via injection molding. Two spaced pivotal seats 12 are formed on the base 18.

The bag 31 made of cloth is mounted on the head frame 10. The bag 31 defines a hole that allows insertion of the pivotal seats 12 and the base 18 during the mounting of the bag 31 on the head frame 10. A thickness of the bag 31 is substantially equal to that of the base 18. Thus, an annular portion of the bag 31 around the hole is flush with the base 18 when the bag 31 is mounted on the head frame 10.

An upper end of each of the supporting rods 20 is pivotally connected with a corresponding one of the pivotal seats 12 by means of a pin.

The board 11, the base 18 and the pivotal seats 12 are integrated with the head frame 10 via injection molding, thus precisely positioning the pivotal seats 12 relative to the head frame 10. Thus, after the bag 31 is mounted on the head frame 12, positioning of the pivotal seats 12 is positively, efficiently and automatically done without the need for any further effort.

The base 18 forms a robust connection between the board 11 and the pivotal seats 12. Thus, a reliable supporting function of the supporting rods 20 pivotally connected with the pivotal seats 12 is ensured.

Figure 4:
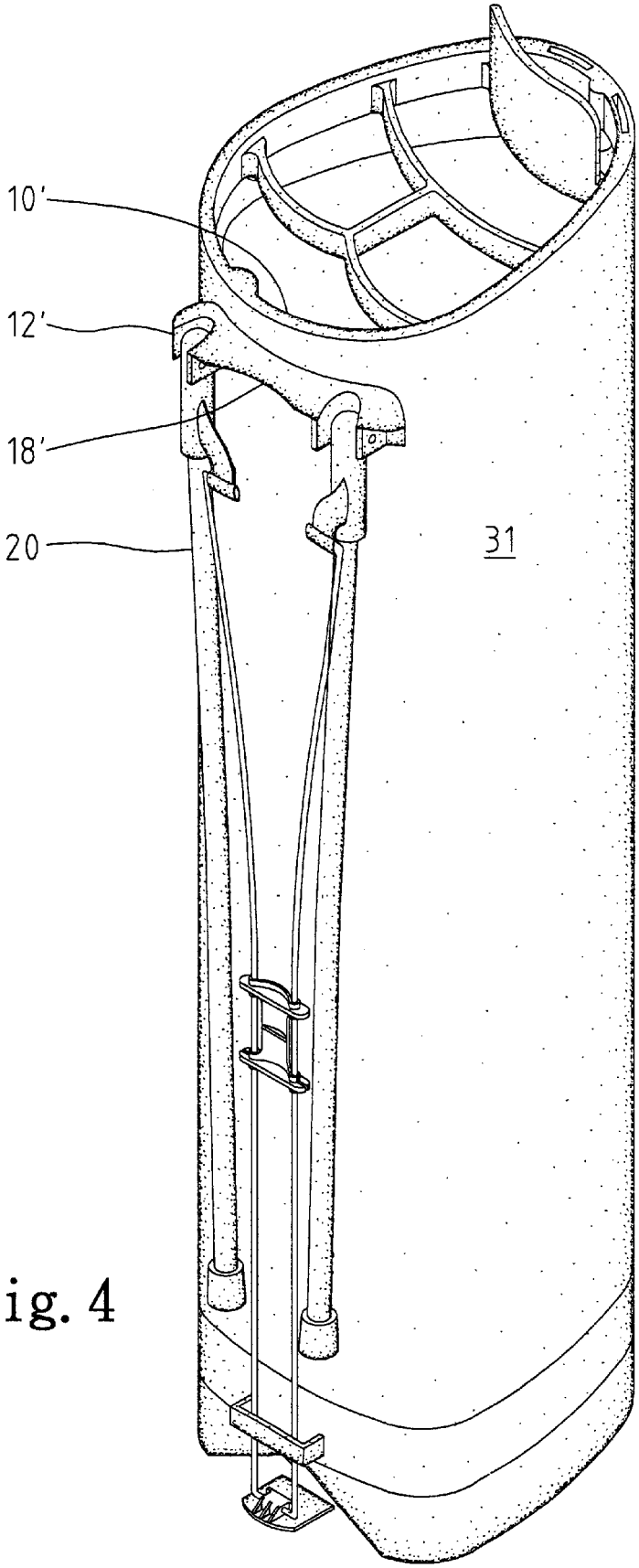
FIG. 4 is a perspective view of a golf club-bagging device according to a second embodiment of the present invention.
Figure 5:
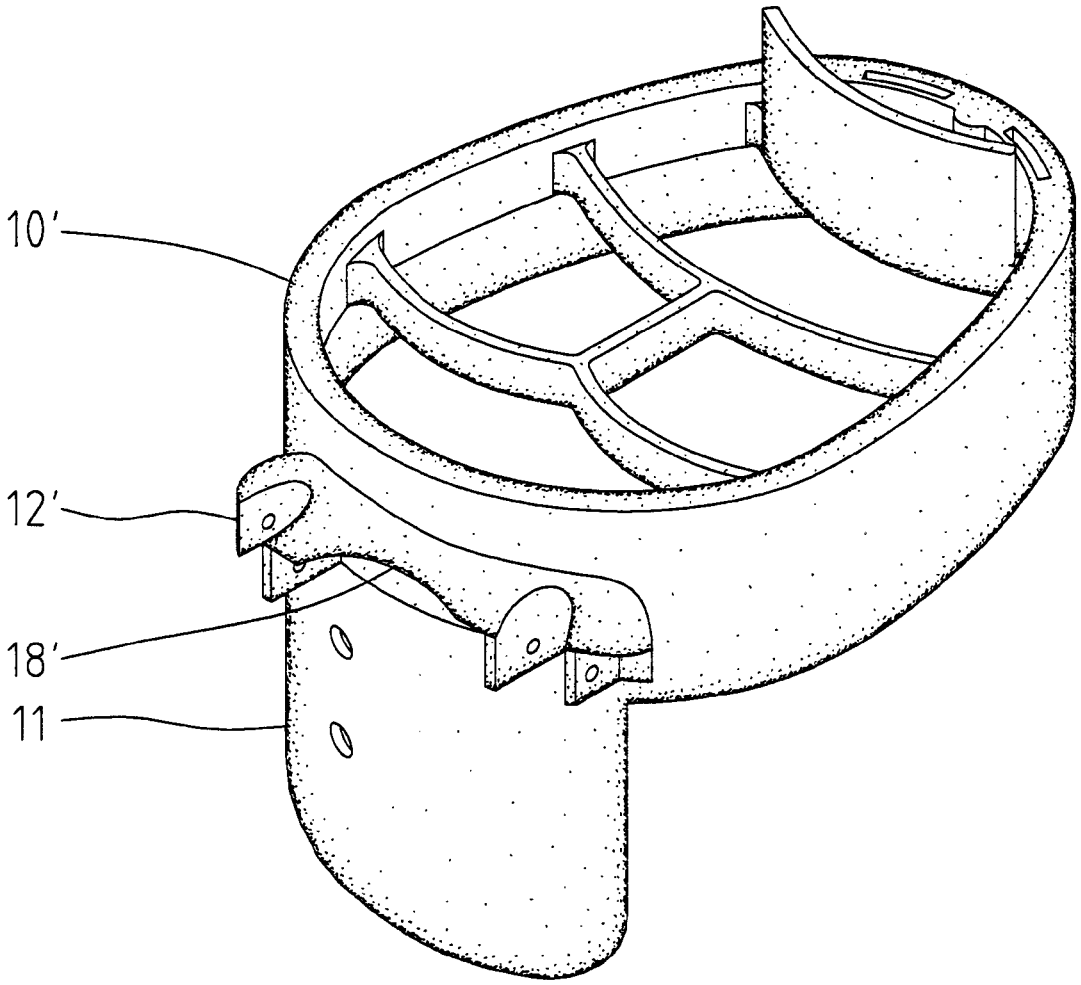
FIG. 5 is a perspective view of a head frame for use in a golf club-bagging device according to the second embodiment of the present invention.
Figure 6:
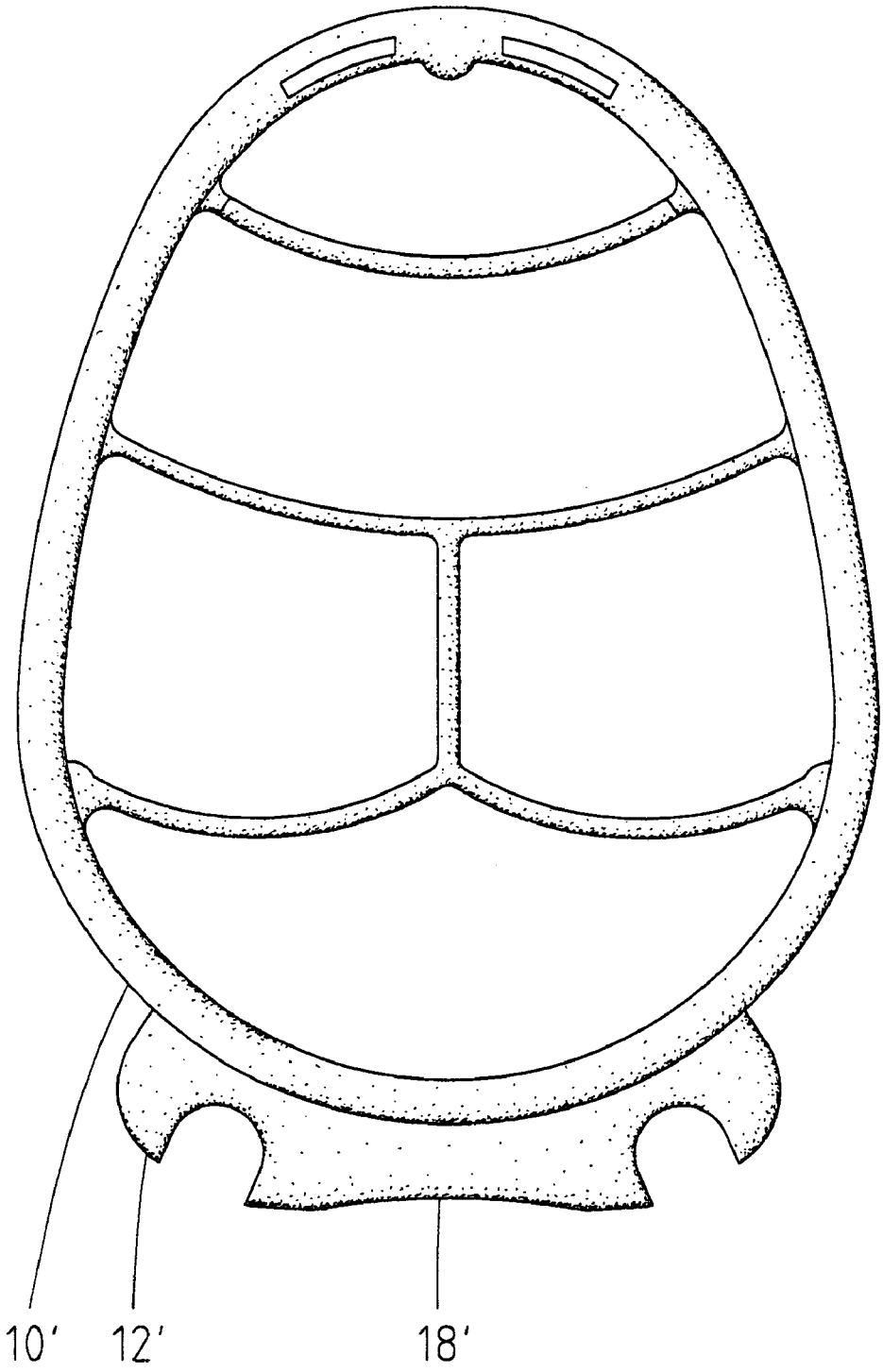
FIG. 6 is a top view of a head frame for use in a golf club-bagging device according to the second embodiment of the present invention.

Referring to FIGS. 4~6, in accordance with a second embodiment of the present invention, a golf club-bagging device includes a head frame 10', a bag 31 mounted on the head frame 10' and two supporting rods 20 pivotally connected with the head frame 10'.

The head frame 10' a board 11 extending from a lower edge thereof, two pivotal seats 12' are formed on the board 11 and an eaves 18' formed on the board 11. An upper end of each of the supporting rods 20 is pivotally connected with one of the pivotal seats 12' by means of a pin.

The board 11, the pivotal seats 12' and the eaves 18' are integrated with the head frame 10' via injection molding, thus obtaining precise positions of the pivotal seats 12. The board 11, the pivotal seats 12' and the eaves 18' are integrated with one another via injection molding. Thus, a reliable supporting function of the supporting rods 20 pivotally connected with the pivotal seats 12' is ensured.

Except for the above-mentioned elements and features, the second embodiment is identical to the first embodiment and therefore will not be further described in detail.

Figure 7:
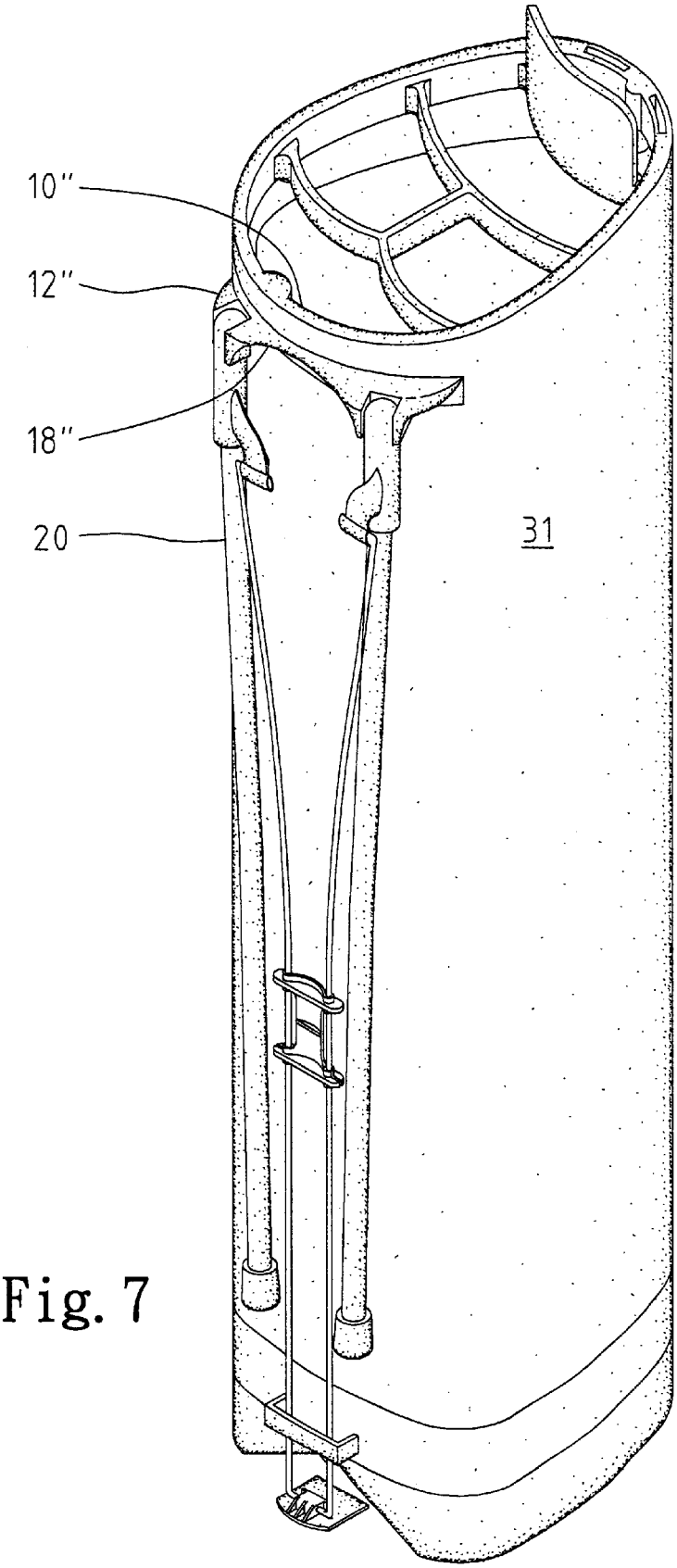
FIG. 7 is a perspective view of a golf club-bagging device according to a third embodiment of the present invention.
Figure 8:
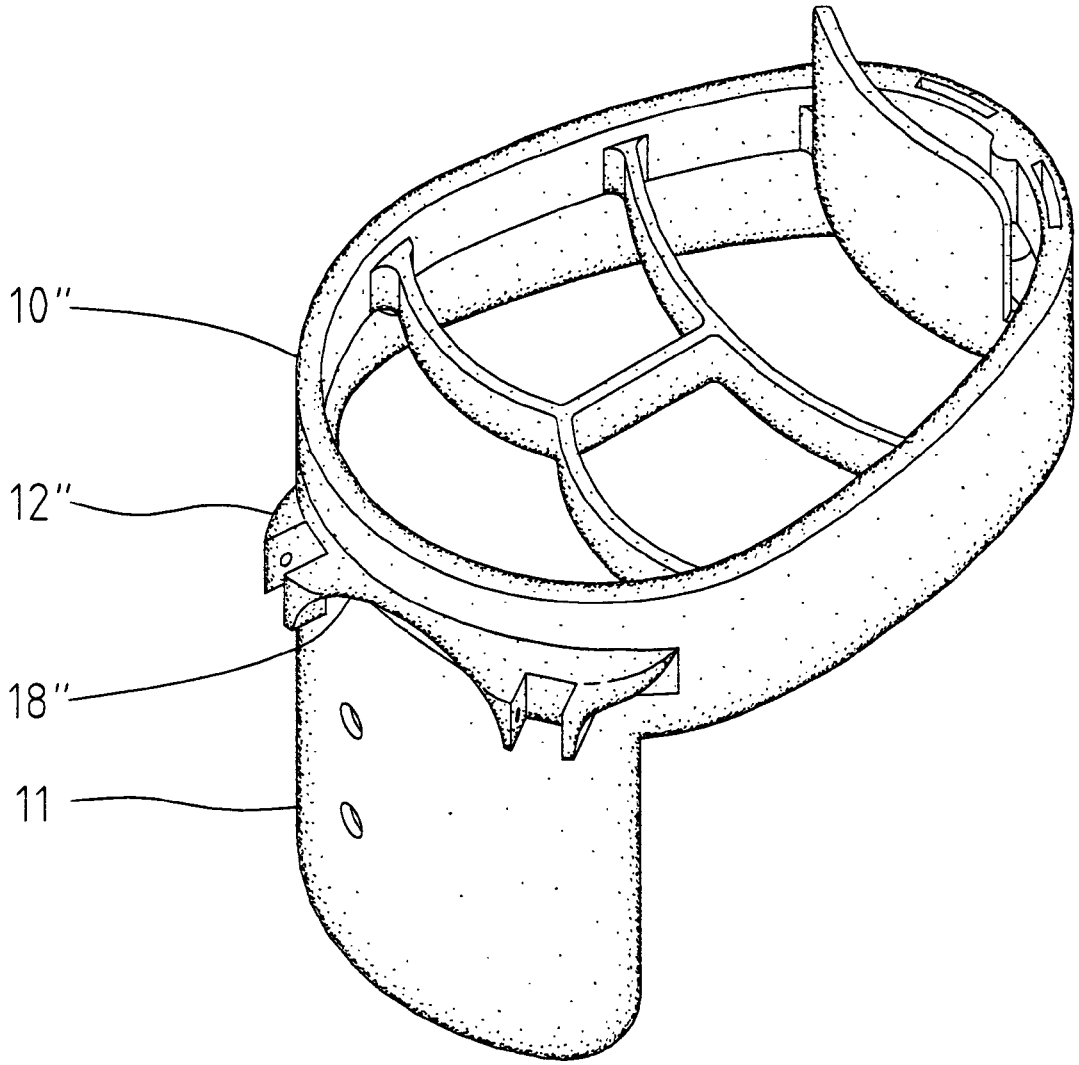
FIG. 8 is a perspective view of a head frame for use in a golf club-bagging device according to the third embodiment of the present invention.
Figure 9:
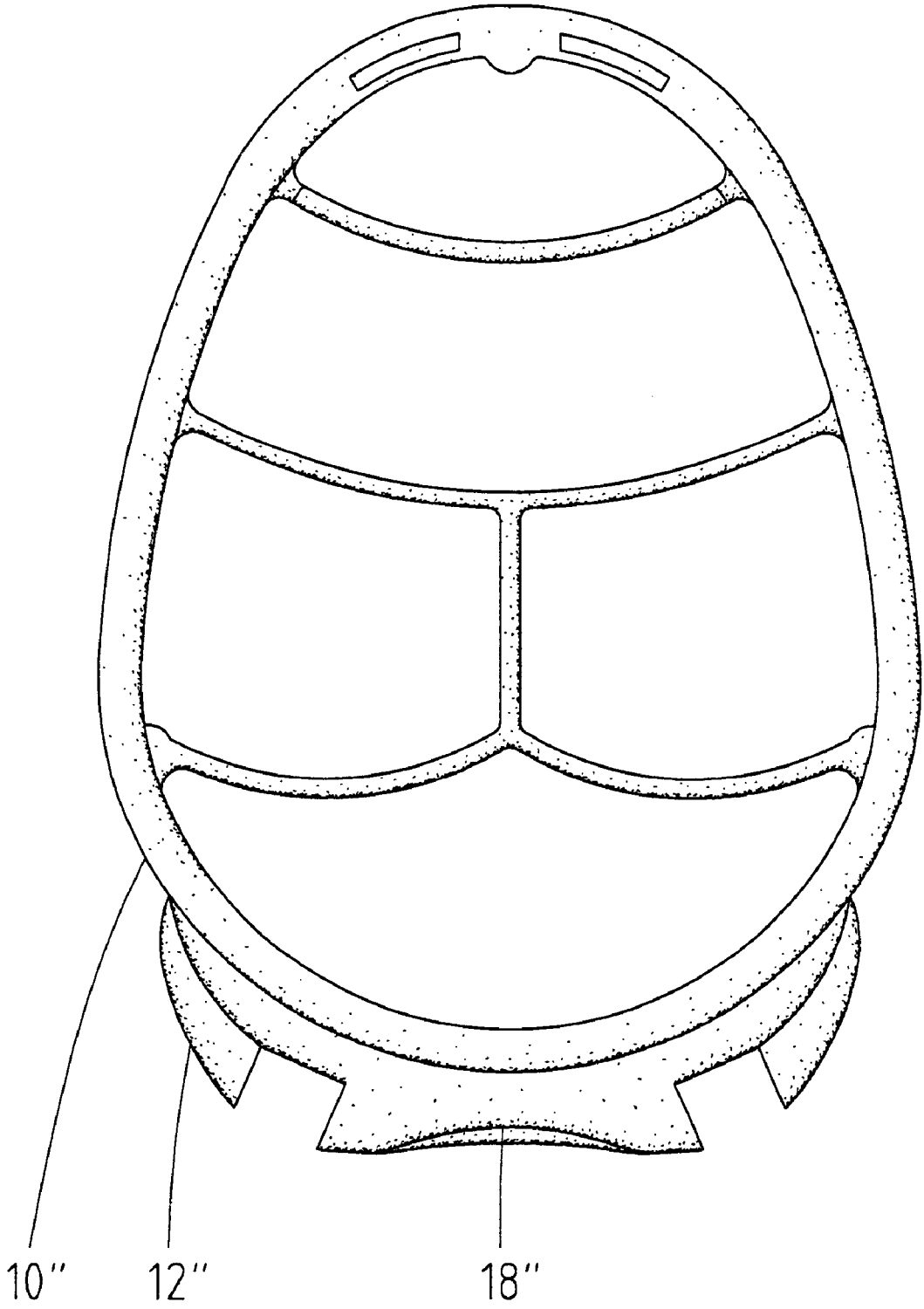
FIG. 9 is a top view of a head frame for use in a golf club-bagging device according to the third embodiment of the present invention

Referring to FIGS. 7~9, in accordance with a third embodiment of the present invention, a golf club-bagging device includes a head frame 10", a bag 31 mounted on the head frame 10" and two supporting rods 20 pivotally connected with the head frame 10".

The third embodiment is identical to the second embodiment but using the pivotal seats 12" instead of the pivotal seats 12' and using the eaves 18" instead of the eaves 18'. The pivotal seats 12" are different from the pivotal seats 12' in shape. The eaves 18" is different from the eaves 18' in shape. Therefore, the third embodiment will not be further described in detail.

Although the invention has been explained in relation to its preferred embodiment, it is to be understood that many other possible modifications and variations can be made without departing from the spirit and scope of the invention as hereinafter claimed.

What is claimed is:

1. A head frame for a golf club-bagging device including a board extending from a lower edge thereof, a base formed on the board and two spaced pivotal seats formed on the base and each pivotally connected with a supporting rod.

2. The head frame according to claim 1 wherein the base is integrated with the board via injection molding.

3. The head frame according to claim 1 wherein the pivotal seats are integrated with the base via injection molding.

4. A head frame for a golf club-bagging device including a board extending from a lower edge thereof, two spaced pivotal seats formed on the board and each pivotally connected with a supporting rod, and an eaves formed on the board connected with the pivotal seats.

5. The head frame according to claim 4 wherein the pivotal seats are integrated with the eaves.

6. The head frame according to claim 5 wherein the pivotal seats are integrated with the eaves via injection molding.

7. The head frame according to claim 4 wherein the pivotal seats are formed on the board via injection molding.

8. The head frame according to claim 4 wherein the eaves is formed on the board via injection molding.

9. A golf club-bagging device including a head frame including a board extending from a lower edge thereof, a base formed on the board and two spaced pivotal seats formed on the base;

a bag defining a hole, the bag being mounted on the head frame so that the pivotal seats and the base are inserted through the hole; and two supporting rods each pivotally connected with one of pivotal seats.

10. The head frame according to claim 9 wherein the bag includes a thickness equal to that of the base so that the bag is flush with the base when the bag is mounted on the head frame.

11. The head frame according to claim 10 wherein the base is integrated with the board via injection molding.

12. The head frame according to claim 10 wherein the pivotal seats are integrated with the base via injection molding.

* * * * *